US009432788B2

(12) United States Patent
Colich et al.

(10) Patent No.: US 9,432,788 B2
(45) Date of Patent: Aug. 30, 2016

(54) THIN FILM CIRCUIT FOR ACOUSTIC TRANSDUCER AND METHODS OF MANUFACTURE

(71) Applicant: Audeze LLC, Costa Mesa, CA (US)

(72) Inventors: Dragoslav Colich, Huntington Beach, CA (US); Kris Cadle, Agoura Hills, CA (US)

(73) Assignee: Audeze LLC, Costa Mesa, CA (US)

( * ) Notice: Subject to any disclaimer, the term of this patent is extended or adjusted under 35 U.S.C. 154(b) by 0 days.

(21) Appl. No.: 14/517,669

(22) Filed: Oct. 17, 2014

(65) Prior Publication Data

US 2015/0110334 A1 Apr. 23, 2015

Related U.S. Application Data

(60) Provisional application No. 61/892,431, filed on Oct. 17, 2013.

(51) Int. Cl.

| | |
|---|---|
| ***H04R 9/06*** | (2006.01) |
| ***H04R 31/00*** | (2006.01) |
| ***H04R 9/04*** | (2006.01) |
| ***H04R 7/04*** | (2006.01) |
| ***H04R 9/02*** | (2006.01) |
| ***H04R 7/06*** | (2006.01) |

(52) U.S. Cl.

CPC ..... *H04R 31/003* (2013.01); *H04R 7/04* (2013.01); *H04R 7/06* (2013.01); *H04R 9/025* (2013.01); *H04R 9/047* (2013.01); *H04R 2307/027* (2013.01)

(58) Field of Classification Search

CPC ..... H04R 7/04; H04R 7/06; H04R 9/025; H04R 9/047; H04R 9/048; H04R 31/003; H04R 2307/027; H04R 2440/01; H03F 3/181

USPC ..... 381/120, 176, 396, 399, 408, 423, 426, 381/427, 431, 409, 410, 412, 421; 330/269, 330/277

See application file for complete search history.

(56) References Cited

U.S. PATENT DOCUMENTS

| | | | | |
|---|---|---|---|---|
| 5,498,997 | A * | 3/1996 | Schiebold | 330/277 |
| 7,236,608 | B2 * | 6/2007 | Garner | 381/399 |
| 2001/0005419 | A1 * | 6/2001 | Kermani et al. | 381/189 |

* cited by examiner

*Primary Examiner* — Huyen D Le

(74) *Attorney, Agent, or Firm* — Robert D. Becker; Manatt, Phelps & Phillips

(57) ABSTRACT

A conductive circuit of a thin film for using in a planar magnetic transducer, where the conductive circuit is created from laser etching, including laser ablation or laser delamination of portions of a conductive material disposed on a diaphragm substrate. The conductive circuit so formed has varied widths, height, or spacing throughout the diaphragm, allowing for adaptation to certain desired performance characteristics. Performance characteristics include a uniform force distribution on the diaphragm, creating very high impedance circuits, increasing current in the circuit, increasing force, and increasing efficiency.

7 Claims, 2 Drawing Sheets

THIN FILM CIRCUIT FOR ACOUSTIC TRANSDUCER AND METHODS OF MANUFACTURE

CROSS-REFERENCE TO RELATED APPLICATIONS

This application claims the benefit of U.S. Provisional Patent Application No. 61/892,431, filed Oct. 17, 2013, the entirety of which is incorporated by reference as if fully set forth herein.

FIELD OF THE INVENTION

The present invention generally relates to thin film circuits, and more particularly, to thin film circuits for acoustic transducers and methods of manufacture.

BACKGROUND OF THE INVENTION

Planar magnetic transducers use a flat, lightweight diaphragm suspended in a magnetic field. The diaphragm in a planar magnetic transducer includes a conductive circuit pattern that, when energized, creates forces that move the diaphragm in the magnetic field to produce sound.

The conductive circuit pattern on the diaphragm can be created using multiple methods. In one approach, conducting wire is applied to the diaphragm base material, or substrate material.

In another approach, diaphragm material is created by laminating a very thin film with conductive material or foil or depositing a layer of conductive material on the film. The next step is to coat this film and foil laminate structure with a chemical resist mask. The film and foil laminate structure is placed in a bath containing the corrosive chemical compounds, allowing the chemical to eats away at the conductive material not concealed by the mask. The conductive material left behind comprises the desired traces.

It is desirable for an improved method for manufacturing thin film circuits for acoustic transducers that provides advantages absent in previous approaches

BRIEF SUMMARY OF PREFERRED EMBODIMENTS OF THE INVENTION

Preferred embodiments of the invention include a diaphragm having a conductive circuit thereon, the diaphragm comprising a substrate layer and a conductive layer, the conductive circuit formed from the conductive layer, wherein a laser is used to remove conductive material from the conductive layer to create the conductive circuit having particular dimensions, the dimensions selected for optimizing performance characteristics of the diaphragm in a planar magnetic transducer.

In preferred embodiments, the performance characteristics comprising a uniform force distribution on the diaphragm, wherein the dimensions of the traces of the conductive circuit selected to match a flux density of a magnetic field for the planar magnetic transducer.

In preferred embodiments, the performance characteristics comprising long length of trace on the diaphragm, wherein the dimensions of the traces have one or more of a width of less than 100 microns or a spacing of less than 100 microns between traces.

In preferred embodiments, the performance characteristics comprising increasing a force on the diaphragm, wherein the dimensions of the traces have one or more of a width of less than 100 microns or a spacing of less than 100 microns between traces to provide a longer total length of trace on the diaphragm.

In preferred embodiments, the performance characteristics comprising increasing a current through the conductive circuit, wherein the dimensions of the traces include a large cross-section to reduce impedance of the circuit.

In preferred embodiments, the performance characteristics comprising the planar magnetic transducer capable of being driven from vacuum tubes, wherein the dimensions of the traces have one or more of a width of less than 100 microns or a spacing of less than 100 microns between traces.

In preferred embodiments, the performance characteristics comprising matching the impedance of the conductive circuit to a specified load impedance, wherein the dimensions of the traces are determined for providing the matching.

BRIEF DESCRIPTION OF THE DRAWINGS

Preferred embodiments of the present invention are illustrated by way of example, and not by way of limitation, in the figures of the accompanying drawings and in which like reference numerals refer to similar elements and in which.

DETAILED DESCRIPTION OF PREFERRED EMBODIMENTS OF THE INVENTION

Figure 1:
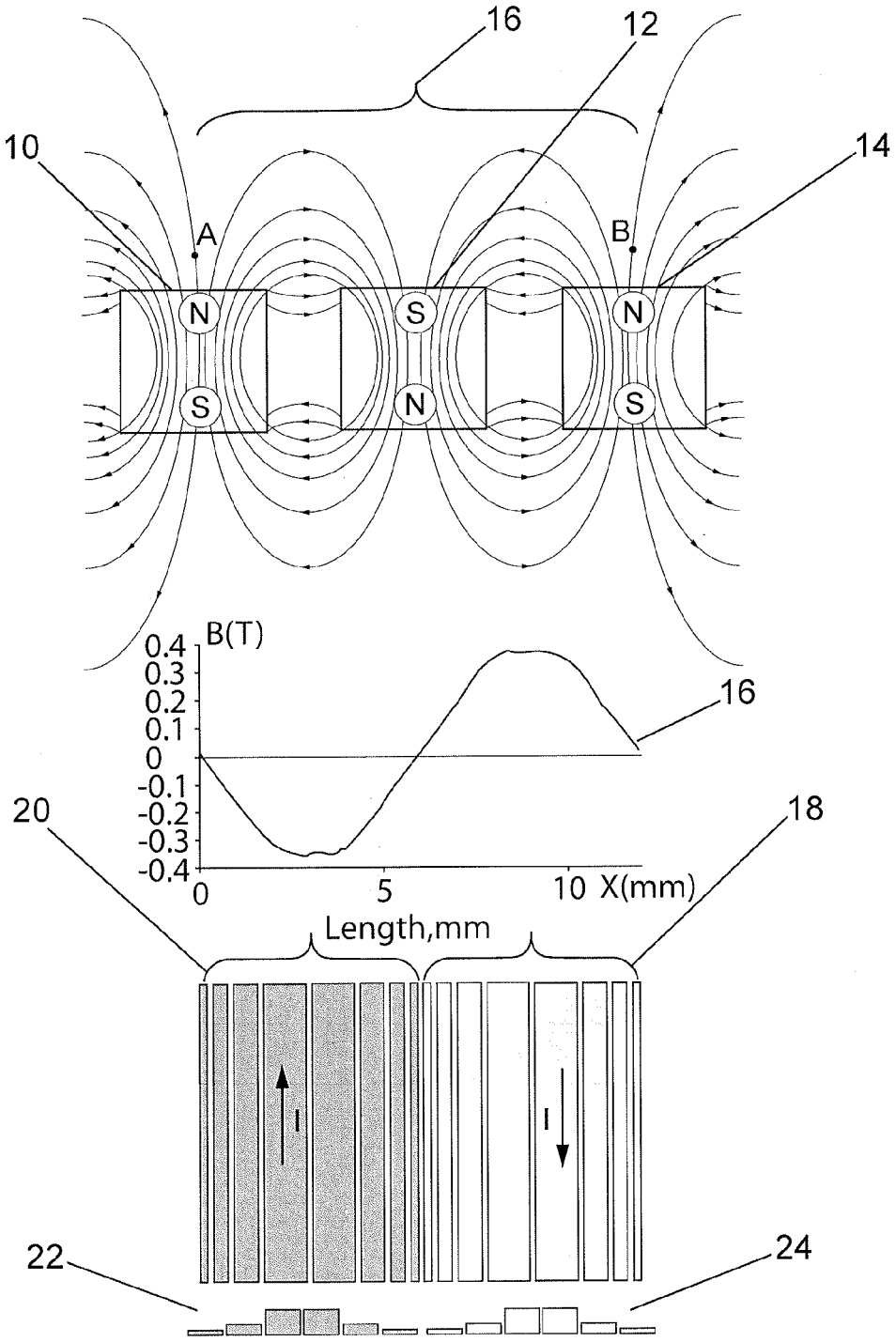
FIG. 1 is a diagram illustrating the relationship between magnetic flux density and optimizing trace height and width in a circuit for creating a uniform force distribution on a diaphragm of an acoustic transducer, according to embodiments of the invention.

Planar magnetic transducers comprise a flat, lightweight diaphragm suspended in a magnetic field. The diaphragm in a planar magnetic transducer includes a conductive circuit pattern that, when energized, creates forces that move the diaphragm in the magnetic field to produce sound.

In some approaches, the conductive circuit pattern is formed by bonding wires to a diaphragm substrate. In other approaches, a thin film substrate is laminated with conductive material, or layer of conductive material, and coated with a chemical resist mask in the desired circuit pattern. The masked film and conductive material structure is placed in a bath containing corrosive chemical compounds that eat away at the conductive material not concealed by the mask, leaving behind the desired pattern of traces.

Other disadvantages include potential mechanical or thermal failure of traces once energized, in case of physical trace damages (pin holes, nicks, mouse bites) during the etching process. Further disadvantage is large impedance variation of the circuit caused by lower etching precision. Chemical Etching of diaphragms also result in lower yields, uneven dimensions, residual chemicals, incomplete stop bath, and etching problems including but not limited to pinholes, mouse bites. In addition to these the process is also causes environmental pollution, chemical waste that has to be treated and additional expenses in fume hoods, dangerous working conditions.

Instead of chemically etching use or wires to form the circuit or using wires to form a circuit, a novel process of laser ablation or delamination is used to remove portions of the conductive material to form the circuit on a diaphragm substrate by irradiating the conductive material with a laser beam.

While the examples herein are described in the context of a thin film circuit on a diaphragm of a planar magnetic speaker, the novel thin film circuits and the techniques for manufacture may be applied to speakers and microphones, array of microphones, array of speakers, fancy circuits, and multi layered circuits.

Diaphragm material consists of a very thin substrate over which is disposed a thin layer comprising conductive material. The conductive material or layer that may be used for creating the circuitry on the diaphragm in accordance with some embodiments of the invention include, but are not limited to, conductive materials and compositions thereof such as copper, aluminum, gold, silver, titanium, beryllium, carbon, tin. The conductive material is disposed onto the substrate by lamination or other depositing processes on one or both faces.

According to some embodiments, the depositing process may include the addition of an adhesive layer to bond the conductive material to the diaphragm substrate. In some embodiments, the conductive material is bonded to the substrate without any layer of adhesive.

According to some embodiments, a laser is used to selectively ablate or delaminate the conductive material on the thin films laminated with conductive material to create a circuit pattern that can be used to create a diaphragm for planar magnetic devices.

FIG. 1 is a diagram illustrating an example of a traces on a thin film substrate in accordance with embodiments of the invention. A planar magnetic transducer includes layer of an array of magnets 10, 12 and 14. In this example, distance 16 between point A and point B is considered for determining the dimensions of the traces.

Each of magnets 10, 12 and 14 generate a magnetic field whose magnetic flux density can be measured. Magnetic flux density graph 16 illustrates the magnetic flux density of the region spanning distance 16 between point A and point B.

In a planar magnetic transducer, at a particular distance from the array of magnets 10, 12, and 14, is positioned a diaphragm with a circuit pattern. The circuit pattern, when energized, causes physical movement of the diaphragm as it encounters the magnetic forces of magnet array 10, 12 and 14. The degree of physical movement of the diaphragm is proportionally related to the amount of conductive material deposited on the substrate and the magnetic flux density.

If the conductive circuitry is uniform across the diaphragm, the diaphragm's movement will not be smooth due to the continuously varying magnetic flux density across the magnets. For example, where the attraction is stronger, the diaphragm will move more at that location, causing ripples in the movement of the diaphragm. Because the diaphragm movement generates a pressure wave that causes sound, ripples in the diaphragm movement will result in a distortion in the sound produced by diaphragm from the intended movement from the signal.

According to some embodiments of the invention, the trace width, trace spacing, and trace height of circuit are varied to match the flux density of the magnetic field. With further reference to FIG. 1, trace widths 18 and 20 are fine where magnetic flux density 16 approaches zero, and are wide where magnetic flux density 16 approaches the greatest positive and negative values, respectively.

According to some embodiments, trace heights 22 and 24 are thinnest where magnetic flux density 16 approaches zero, and thickest where magnetic flux density 16 approaches the greatest positive and negative values, respectively. Traces according to some embodiments are etched by ablation or delamination of the conductive material using lasers to allow precise control of the etching to achieve the desired trace pattern.

By matching the flux density of the magnetic field in a planar magnetic speaker, a uniform force distribution is created across the diaphragm to avoid the undesired rippling in the diaphragm during sound production by the planar magnetic transducer.

Figure 2:
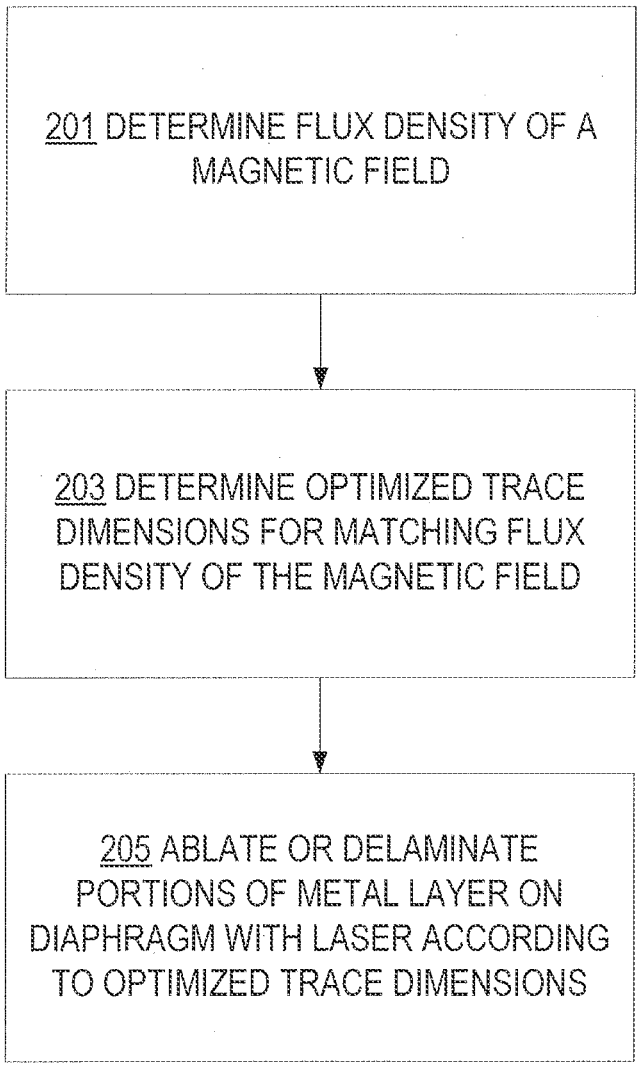
FIG. 2 is flow diagram illustrating a method for creating a uniform force distribution on the diaphragm of an acoustic transducer, according to embodiments of the invention.

FIG. 2 illustrates a process for making a diaphragm for a planar magnetic speaker, where the diaphragm is moved by a uniform force distribution created by a magnet array and the conductive circuit pattern on the diaphragm. At step 201, the flux density of a magnetic field is determined. Based on the flux density, at step 203, optimized trace dimensions are determined for matching the flux density of the magnetic field to create a uniform force distribution. In some embodiments, trace heights are thinnest where magnetic flux density approaches zero, and thickest where magnetic flux density approaches the greatest positive and negative values, respectively. In some embodiments, trace widths are finest where magnetic flux density approaches zero, and are widest where magnetic flux density approaches the greatest positive and negative values, respectively. At step 205, the deposited conductive material on the diaphragm is either ablated or delaminated as needed to create a conductive circuitry with the optimized trace dimensions.

In addition to creating circuits allowing for a uniform force distribution when used in planar magnetic transducers, this method of using lasers to selectively ablate or delaminate the conductive material laminated on very thin films can be used to create circuitry on a thin film substrate that increases efficiency and to generate higher output.

In some embodiments, laser ablation and delamination is used to make speaker diaphragms with very fine trace widths and spacing between traces. Existing technologies (chemical etch, vapor deposition etc) have limits on how fine the traces can be and how fine the spacing between traces can be achieved. Typically, the trace width is bigger than 100 microns, and spacing is also bigger than 100 microns. In contrast, laser etching techniques enables line widths and spacing of less than 1 micron. Because laser etching allows planar magnetic transducer diaphragms with finer trace widths, the efficiency and the power density of the circuit is increased by maximizing the cross section of the trace pattern.

As shown in Equation 1, where F=Force, B=Magnetic Flux Density, L=Length of the trace, and I=Current, if I is constant, the longer the length of the coil, for the same current, increases the force on the diaphragm.

$$F=B\times I\times L \tag{1}$$

Laser etching of the conductive material to produce conductive circuitry on the diaphragm reduces the impedance of the circuit and increases the current through the conductor in comparison with traditional etching techniques. The precise control of the etching allows varying thickness of the traces to increase the cross-section of the trace, which reduces the impedance of the circuit. Finer traces allows an increase in total coil length that can fit onto a diaphragm of limited size. The combination of increasing cross section and increasing coil length allows more current to be pushed through the circuit, and to generate much higher output, increasing both I and L in Equation 1. The effect on efficiency E of reducing impedance R and increasing length of trace L is shown by Equation 2.

$$E = \frac{(B \times L)^2}{R} \tag{2}$$

The ability to create finer traces and to vary the thickness of the cross-section of the trace also allows very high impedance circuits to be created, which were not possible with traditional methods. Very high impedance circuits on diaphragms allow the planar transducers to be driven directly from vacuum tubes without output transformers.

Other advantages of laser etching includes speed and on-demand production of different trace specifications. Speed and on-demand production allows customization of the acoustic transducers to different amplifiers, which have different requirements for load impedance. Diaphragm can be produced on-demand to deliver the most optimal circuit impedance for a given amplifier.

Other features, aspects and objects of the invention can be obtained from a review of the figures and the claims. It is to be understood that other embodiments of the invention can be developed and fall within the spirit and scope of the invention and claims.

The foregoing description of preferred embodiments of the present invention has been provided for the purposes of illustration and description. It is not intended to be exhaustive or to limit the invention to the precise forms disclosed. Various additions, deletions and modifications are contemplated as being within its scope. The scope of the invention is, therefore, indicated by the appended claims rather than the foregoing description. Further, all changes which may fall within the meaning and range of equivalency of the claims and elements and features thereof are to be embraced within their scope.

What is claimed is:

1. A diaphragm having a conductive circuit thereon, the diaphragm comprising a substrate layer and a conductive material over the substrate layer, the conductive circuit formed from the conductive material, wherein a laser is used to remove portions of the conductive material to create the conductive circuit having particular dimensions of traces, the dimensions of the traces varying and selected for optimizing performance characteristics of the diaphragm in a planar magnetic transducer.

2. The diaphragm of claim 1, the performance characteristics comprising a uniform force distribution on the diaphragm, wherein the dimensions of the traces of the conductive circuit selected to match a flux density of a magnetic field for the planar magnetic transducer.

3. The diaphragm of claim 1, the performance characteristics comprising long length of trace on the diaphragm, wherein the dimensions of the traces have one or more of a width of less than 100 microns or a spacing of less than 100 microns between traces.

4. The diaphragm of claim 1, the performance characteristics comprising increasing a force on the diaphragm, wherein the dimensions of the traces have one or more of a width of less than 100 microns or a spacing of less than 100 microns between traces to provide a longer total length of trace on the diaphragm.

5. The diaphragm of claim 1, the performance characteristics comprising increasing a current through the conductive circuit, wherein the dimensions of the traces include a large cross-section to reduce impedance of the circuit.

6. The diaphragm of claim 1, the performance characteristics comprising the planar magnetic transducer capable of being driven directly from vacuum tubes without using matching transformer, Wherein the dimensions of the traces have one or more of a width of less than 100 microns or a spacing of less than 100 microns between traces.

7. The diaphragm of claim 1, the performance characteristics comprising matching the impedance of the conductive circuit to a specified load impedance, wherein the dimensions of the traces are determined for providing the matching.

* * * * *